United States Patent [19]

Hamstra

[11] 4,011,498

[45] Mar. 8, 1977

[54] CONTROLLING CIRCUIT

[75] Inventor: David C. Hamstra, Clinton, Iowa

[73] Assignee: General Electric Company, Fort Wayne, Ind.

[22] Filed: June 26, 1975

[21] Appl. No.: 590,504

[52] U.S. Cl. ..... 323/21; 323/24; 323/36

[51] Int. Cl.[2] ..... G05F 1/44

[58] Field of Search ..... 307/252 B, 252 N, 252 P, 307/296, 297, 311; 323/21, 22 SC, 24, 34, 36

[56] References Cited

UNITED STATES PATENTS

| | | | |
|---|---|---|---|
| 3,328,673 | 6/1967 | Nuckolls | 323/21 |
| 3,344,310 | 9/1967 | Nuckolls | 315/199 |
| 3,344,311 | 9/1967 | Nuckolls | 315/199 |
| 3,353,078 | 11/1967 | Maynard | 323/34 UX |
| 3,358,217 | 12/1967 | Deelman | 323/21 |
| 3,500,174 | 3/1970 | Ellerbeck | 323/24 |
| 3,524,997 | 8/1970 | Harnden et al. | 307/252 B |
| 3,638,043 | 1/1972 | Laupman | 307/252 B |
| 3,761,789 | 9/1973 | Krafft et al. | 323/24 X |
| 3,777,188 | 12/1973 | Mazur | 323/21 X |
| 3,952,242 | 4/1976 | Ukai | 323/21 |

*Primary Examiner*—A. D. Pellinen
*Attorney, Agent, or Firm*—Joseph E. Papin

[57] ABSTRACT

A circuit for controlling the application of power from a source thereof to a load. In this controlling circuit, a phase control circuit is provided for supplying current from the source to the load for varying voltage applied to the control node to maintain the effective voltage near a preferred value despite variations in the voltage of the source. An initializing circuit is also provided for preventing the application of excessive voltage to the load upon the initial energization of the controlling circuit.

10 Claims, 1 Drawing Figure

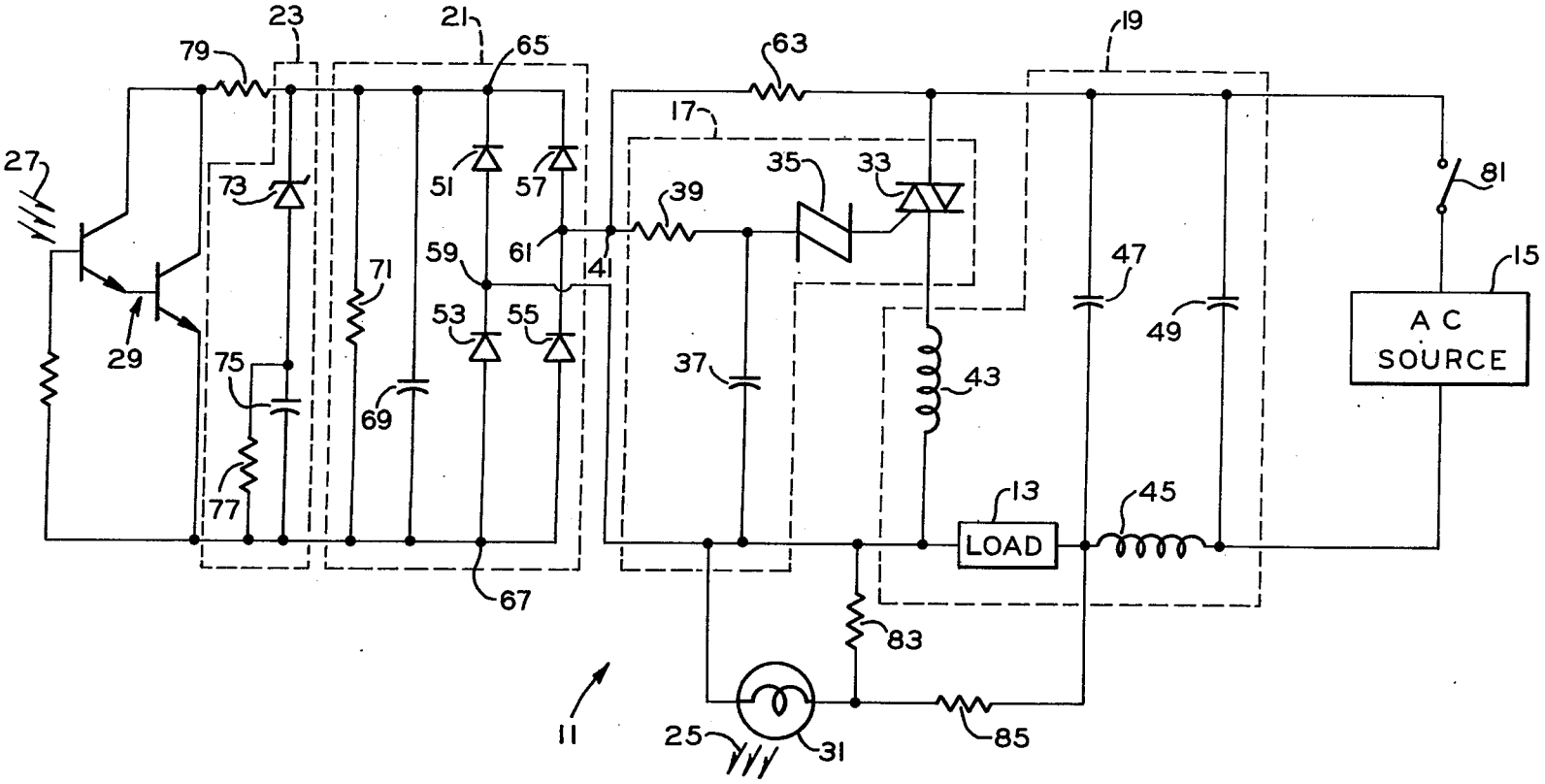
A C
SOURCE
LOAD

CONTROLLING CIRCUIT

BACKGROUND OF THE INVENTION

The present invention relates generally to electrical circuits and more particularly to a controlling circuit operable generally to maintain the effective value of an alternating current voltage applied to a load near a desired value.

In the past, many voltage regulating circuits were known having direct current regulation accomplished by devices, such as zener diodes or the like, where voltage is substantially independent of current flow once the zener voltage has been exceeded. Regulation of peak alternating current voltages was similarly accomplished by utilizing means well known to the art for "clipping" peak values thereof; however, such clipping to regulate peak voltage does not simultaneously regulate the effective voltage. This follows since, the greater the degree of clipping, the more nearly the applied voltage waveform approximates a square wave and the greater the effective or RMS value of that voltage becomes.

Systems or circuits for regulating the effective or RMS value of an applied voltage have also been proposed. Some of these circuits employed optical feedback paths and also frequently employed silicon controlled rectifiers or other similar devices. In this manner, the relative phase at which the silicon controlled rectifier was triggered determined the effective value of the voltage applied to the load, and the optical feedback path responsive to a lamp or the like in parallel with the load controlled this phase angle thereby to maintain the effective voltage at or near a desired level. Such controlling circuits typically employed relatively expensive transformers and numerous circuit elements resulting in a relatively expensive control system. Further, such controlling circuits frequently supplied only the phase angle determined portions of successive current excursions of like polarity to the load and thus constituted a type of half-wave rectification prior to the load. For the foregoing as well as other reasons, such known controlling circuits have been unsuited to low cost applications, such as regulating the effective voltage applied to a projection lamp in photo projection equipment, such as slide projectors, overhead projectors, and movie projectors or the like.

SUMMARY OF THE INVENTION

Among the several objects of the present invention may be noted the provision of an improved circuit for controlling the power applied to a load, such as a projection lamp in one form of the invention; the provision of such circuit for supplying an alternating current having a regulated effective voltage to a load coupled with at least one direct current circuit element in a feedback path; the provision of such circuit for supplying an alternating current having a regulated effective voltage to a load coupled with a light sensitive Darlington transistor in an optical feedback path; the provision of such circuit for controlling the power applied to a load which prevents the application of excessive voltage to the load upon initial energization of the circuit; and the provision of such circuit which is simplistic in design, economical to manufacture and easily assembled and maintained. Other objects and features will be in part apparent and in part pointed out hereafter.

In general, a circuit in one form of the invention is provided for controlling the application of power from a source thereof to a load. This controlling circuit has a phase control circuit for supplying current from the source to the load, and the phase control circuit has a voltage responsive control node. Means is responsive to an effective voltage applied to the load for varying the voltage applied to the control node to maintain the effective voltage to the load near a preferred value despite variations in the voltage of the alternating current source. Initializing circuit means is coupled to the control node for limiting the initial node voltage thereby preventing the application of excessive voltage to the load upon initial energization of the controlling circuit, and the initializing circuit includes a zener diode and a capacitor connected in series. A diode bridge network is provided for coupling the initializing circuit to the control node and has opposite alternating current junctions, one of which is connected directly to the control node with opposite direct current junctions connected across the series combination of the zener diode and capacitor.

BRIEF DESCRIPTION OF THE DRAWING

The drawing illustrates, in schematic form a controlling circuit in one form of the invention.

Corresponding reference characters indicate corresponding parts through the drawing.

The exemplifications set out herein illustrate the preferred embodiment of the invention in one form thereof, and such exemplifications are not to be construed as limiting the scope of the invention in any manner.

DESCRIPTION OF THE PREFERRED EMBODIMENT

Referring now to the drawing in greater detail, there is indicated generally at 11 a circuit for controlling the application of power to a load 13 which may, for example, be a photo projection lamp or the like from a source 15 of the power which may be an alternating current power source. Controlling circuit 11 functionally comprises a bilateral phase control circuit 17, an electromagnetic interference suppression circuit 19 interposed between source 15 and load 13, an alternating current to direct current converter, such as a diode bridge network 21 for instance, and an initializing or delay circuit 23 which prevents over-voltage to the load when the controlling circuit is initially energized. An optical feedback path 25, 27 is provided when a light sensitive Darlington transistor 29 is illuminated by a lamp 31.

Phase control circuit 17 employs a bilateral or full wave semiconductor switching device, such as a Triac 33 or the like, and the gate of the Triac is connected to a trigger or triggering element or device 35 which may be any of several commercially available semiconductor devices that break down to conduct when the voltage thereacross exceeds some predetermined value. As depicted, trigger 35 will conduct to enable Triac 33 when the voltage across a capacitor 37 exceeds a specified amount. An R-C circuit is defined, at least in part, by capacitor 37 and a resistor 39 which is connected with a control node 41 of phase control circuit and triggering element 35. In this manner, when trigger element 35 breaks down so as to conduct the charge on capacitor 37 is, in effect, dumped to the gate of Triac 33 so as to effect the conductive state thereof.

Electromagnetic interference suppression circuit 19 includes the impedance of load 13 and also is provided with a pair of radio frequency chokes 43, 45 as well as a pair of capacitors 47, 49. Choke 45 and capacitors 47, 49 are connected in a pi configuration.

Alternating current to direct current converter 21 includes a plurality of diodes 51, 53, 55 and 57 connected in a bridge arrangement with a pair of opposite alternating current junctions 59, 61 which are effectively connected in series with source 15 and an impedance 63. Choke 45 is effectively a direct connection at the typical 60 cycle source frequency. Diode bridge circuit 51, 53, 55, 57 also has another pair of opposite direct current junctions 65, 67 across which a capacitor 69 is connected for the purpose of smoothing the full wave rectified voltage to a DC level. A bleeder resistor 71 is connected in parallel with capacitor 69 to form a discharge path for that capacitor thereby providing a short reset time for controlling circuit 11 whenever the power thereto is interrupted.

Initializing circuit 23 includes a zener diode 73 in series with a capacitor 75 across junctions 65, 67 of converter 21 and functions to insure that the voltage across those terminals remains low when controlling circuit 11 is initially energized. A bleeder resistor 77 is connected in parallel with capacitor 75 to discharge that capacitor when controlling circuit 11 is de-energized and again may be selected for a short reset time.

Still further in parallel with direct current junctions 65, 67 is a series combination of a resistor 79 and the light sensitive Darlington transistor pair 29, and, of course, variations in the conduction of the Darlington photo transistor 29 causes related variations in the impedance between junctions 59, 61. Junctions 59, 61 are effectively connected in series with an impedance, such as a resistor 63, across alternating current source 15 so that the voltage between junctions 59, 61 is a fraction of the source voltage, as determined by the relative magnitudes of impedance 63 and the effective impedance between junctions 59, 61.

When alternating current is initially applied to the circuit, for example, by closing a switch 81, the charge on capacitor 75 is 0 and the voltage at node 61 relative to that at junction 59 is limited to not more than the zener break-down voltage of zener diode 73. Zener diode 73 is selected to have a break-down voltage slightly below the normal operating point of the bilateral or full wave phase control circuit 17. Thus, the voltage initially applied to load 13 is slightly below its normal operating voltage. As capacitor 75 charges, the voltage at node 41 may build to that determined by the voltage division between resistor 63 and current limiting resistor 79 in series with photo Darlington transistor 29. As this charge on capacitor 75 builds, initializing or delay circuit 23 completes its function, and the circuit reaches its normal steady state regulation mode of operation.

A pair of resistors 83, 85 generally constitute a voltage divider network or circuit across load 13, and therefore, the voltage supplied to lamp 31 is proportional to the voltage across the load both on an instantaneous and on an effective or RMS basis. If the efective value of the voltage across load 13 is too high, lamp 31 will be illuminated at a higher than normal intensity, and by way of optical feedback path 25, 27, photo Darlington transistor 29 will be conducting more than at steady state thereby reducing the effective impedance of a portion of the voltage divider circuit. In this manner, the voltage at node 41 is diminished so as to correspondingly increase the charging time for capacitor 37 and ultimately causes Triac 33 to fire or conduct at a later time for each half cycle of the alternating current source. This later firing angle for Triac 33 reduces the effective value of the voltage supplied to load 13 and diminishes the intensity of lamp 31 thereby to bring about the control desired. If an inadequate effective voltage is being supplied to load 13, the intensity of lamp 31 is diminished thereby also diminishing conduction through transistor 29 which increases the voltage at node 41 and allows capacitor 37 to more quickly accumulate a charge sufficient to trigger the triggering device 35 which, in turn, triggers Triac 33 thereby to ultimately increase the effective voltage to load 13. Thus, the feedback path which provides the control in one form of the present invention includes incandescent lamp 31, which is energized by the voltage across load 13, and light sensitive semiconductor 29, which semiconductor device is electrically disposed in the voltage divider circuit and optically enabled by energization of the lamp to change the impedance of the voltage divider circuit.

As noted earlier, a particular application for controlling circuit 11 in one form of the present invention is in photo projection equipement where the light output of projection lamps varies approximately as the fourth power of the applied voltage. Under such circumstances, it is highly desirable to hold the voltage to the projector lamp constant for proper operation. In a particular embodiment, according to the drawing, a 50 or 60 hertz alternating current source which varied between 200 and 250 volts provided a load voltage to a projector lamp having a 120 volt RMS value within plus or minus 5 volts, a result which is believed to be undetectable to a viewer.

An added benefit of the present invention, when used as a control for projection lamps, is believed to be increased lamp life. One of the failure modes of such lamps is thermal shock fatigue of the filaments due to fast thermal gradient when such lamps are energized. The soft start characteristics of controlling circuit 11 may be tailored to turn the lamp on slowly thus reducing such temperature shock to the filament.

If initializing circuit 23 is eliminated, overshoot of the load voltage may occur on starting. One to two electrical cycles are required to heat the filament of lamp 31 sufficiently, and during this time, transistor 29 is at minimum conduction providing a maximum control voltage at node 41 and possibly an excessive voltage to the load 13.

The following list illustrates component values which may be employed for the electronic components of controlling circuit 11.

| Component | Values |
|---|---|
| 27, 29 | 0.25 amps, 25 v. |
| 33 | 25 amps, 400 v. |
| 35 | 9 v. |
| 37 | 0.1 u.f. |
| 39 | 68 K. |
| 43 | 100 u.h. |
| 45 | 300 u.h. |
| 47 | 28 u.f. |
| 49 | 0.33 u.f. |
| 51, 53, 55, 57 | 0.5 amp, 50 v. |
| 63, 71 | 100 K. |
| 69 | 10 u.f. |
| 73 | 12 v. |
| 75 | 470 u.f. |
| 77 | 10 K. |

-continued

| Component | Values |
|---|---|
| 79 | 1 K. |
| 83 | selected value |
| 85 | 2.5 K. |

From the foregoing it is now apparent that a novel controlling circuit 11 has been presented meeting the objects and advantageous features set out hereinbefore, as well as others. Further, it is contemplated that changes as to the particular arrangements, shapes, details and connections of the component parts of such novel control circuit, which are presented merely for purposes of disclosure to illustrate the invention, may be made by those having ordinary skill in the art without departing from the spirit of the invention or the scope thereof, as set out in the claims which follow.

What I claim as new and desire to secure by Letters Patent of the U.S. is:

1. A circuit for controlling the application of power from a source thereof to a load comprising:

a phase control circuit for supplying current from the source to the load and having a voltage responsive control node;

means responsive to an effective voltage applied to the load for varying the voltage applied to the control node to maintain the effective voltage to the load near a preferred value despite variations in the voltage of the source;

initializing circuit means coupled to the control node for limiting the initial node voltage thereby preventing the application of excessive voltage to the load upon initial energization of the controlling circuit including a zener diode and a capacitor connected in series; and a diode bridge network for coupling the initializing circuit to the control node having opposite alternating current junctions, one of which is connected directly to the control node and having opposite direct current junctions connected across the series combination of the zener diode and capacitor.

2. A circuit as set forth in claim 1, wherein the varying means comprises a voltage divider circuit for supplying a portion of the voltage thereacross to the control node and feedback path means responsive to the effective voltage applied to the load for varying a portion of the voltage divider circuit and thereby also the voltage applied to the control node.

3. A circuit as set forth in claim 2, wherein the feedback path means includes an incandescent lamp energized by the voltage across the load, and a light sensitive semi-conductor device in the voltage divider circuit optically enabled by energization of the lamp to change the impedance of the voltage divider circuit.

4. A circuit as set forth in claim 1, wherein the phase control circuit includes a gate controlled full wave semiconductor switch, and means for coupling the gate of the switch to the control node to enable the switch during a portion of successive half cycles of the alternating current source, the initializing circuit capacitor having a charge which increases during successive half cycles immediately following initial energization of the controlling circuit allowing corresponding increases in the control node voltage.

5. A circuit as set forth in claim 1, further comprising means interposed between the source and the load for suppressing electromagnetic interference, and a bleeder resistor connected in parallel with the initializing circuit capacitor to discharge that capacitor when the control circuit is deenergized.

6. A circuit for controlling the application of an alternating current having a regulated effective voltage from a source thereof to a load comprising:

a phase control circuit for supplying current from the source to the load and having a voltage responsive control node, the phase control circuit including a gate controlled full wave semiconductor switch, a resistance and capacitance connected in series and to the control node, a normally non-conducting alternating current trigger element coupling the gate of the full wave semiconductor switch and the junction of the series connected resistance and capacitance to conduct when the charge on the capacitance exceeds a predetermined breakdown voltage;

a voltage divider circuit for supplying a portion of the voltage thereacross to the control node, the voltage divider circuit including at least a direct current portion and an alternating current portion including an impedance connected in series with the source; and feedback path means responsive to the effective voltage applied to the load for varying a portion of the voltage divider circuit and thereby also the voltage applied to the control node to maintain the effective voltage to the load near a preferred value despite variations in the voltage of the alternating current source, the feedback path means including an incandescent lamp energized by the voltage across the load, and a light sensitive semiconductor device in the voltage divider circuit direct current portion optically enabled by energization of the lamp to change the impedance of the voltage divider circuit;

the voltage divider circuit including a bridge diode circuit having a pair of opposite alternating current junctions connected between the source and the impedance and a pair of opposite direct current junctions, and further comprising means connected between the opposite direct current junctions for preventing the application of excessive voltage to the load upon initial energization of the load, the series resistance and capacitance of the phase control circuit being connected to the opposite alternating current junctions.

7. A circuit for controlling the application of power from a source thereof to a load comprising:

means for applying current from the source to the load and having an alternating current voltage responsive control node;

means for supplying a portion of the alternating current voltage to the control node;

means responsive to an effective voltage applied to the load for varying a portion of the supplying means and thereby also the voltage applied to the control node to maintain the effective voltage to the load near a preferred value in the event of variations in the voltage of the source including an incandescent lamp energized by the voltage across the load and a light sensitive semiconductor device associated with the supplying means and optically enabled by energization of the lamp to change the impedance of the supplying means;

means coupled to the control node for preventing the application of excessive voltage to the load upon initial energization of the controlling circuit including a zener diode and a capacitor connected in series; and the means for supplying including a gate controlled full wave semiconductor switch, a resistance and a capacitance connected in series and to the control node, a normally nonconducting alternating current trigger element coupling the gate of the full wave semiconductor switch and the junction of the capacitance and resistance to conduct when the charge on the capacitor exceeds a predetermined breakdown voltage.

8. A circuit as set forth in claim 7, wherein the supplying means includes an alternating current to direct current converter, and an impedance connected in series with the source.

9. A circuit as set forth in claim 8, wherein the converter comprises a diode bridge circuit including a pair of opposite alternating current junctions connected between the source and the impedance, and a pair of opposite direct current junctions the preventing means being connected between the opposite direct current junctions.

10. A circuit as set forth in claim 7, further comprising means interposed between the source and the load for suppressing electromagnetic interference.

* * * * *